US007967071B2

(12) United States Patent
Brown

(10) Patent No.: US 7,967,071 B2
(45) Date of Patent: Jun. 28, 2011

(54) ELECTRONIC COMPLETION INSTALLATION VALVE

(75) Inventor: Irvine C. Brown, Aberdeen (GB)

(73) Assignee: Red Spider Technology Limited, Westhill, Aberdeenshire (GB)

( * ) Notice: Subject to any disclaimer, the term of this patent is extended or adjusted under 35 U.S.C. 154(b) by 65 days.

(21) Appl. No.: 12/380,309

(22) Filed: Feb. 26, 2009

(65) Prior Publication Data

US 2009/0218104 A1 Sep. 3, 2009

(30) Foreign Application Priority Data

Mar. 1, 2008 (GB) ..... 0803925.7

(51) Int. Cl.
*E21B 34/16* (2006.01)
*E21B 33/12* (2006.01)

(52) U.S. Cl. .... 166/373; 166/66.6; 166/319; 166/332.3; 166/188; 166/386

(58) Field of Classification Search ..... 166/373–375, 166/316, 319, 329, 332.1, 332.2, 332.3, 66.4, 166/65.1, 66.6, 188, 184, 142, 386
See application file for complete search history.

(56) References Cited

U.S. PATENT DOCUMENTS

| | | | | |
|---|---|---|---|---|
| 5,358,035 | A * | 10/1994 | Grudzinski | 166/53 |
| 6,173,772 | B1 * | 1/2001 | Vaynshteyn | 166/250.15 |
| 6,364,023 | B1 * | 4/2002 | Hiron et al. | 166/373 |
| 6,851,481 | B2 * | 2/2005 | Vinegar et al. | 166/374 |
| 6,945,331 | B2 | 9/2005 | Patel | |
| 7,108,073 | B2 | 9/2006 | Patel | |
| 2007/0102164 | A1 * | 5/2007 | Mackenzie | 166/386 |
| 2007/0125554 | A1 | 6/2007 | Reid | |

FOREIGN PATENT DOCUMENTS

| | | |
|---|---|---|
| GB | 2391566 | 2/2004 |
| WO | WO-2007049046 | 5/2007 |

OTHER PUBLICATIONS

Flyer from Halliburton Corporation on the "Mirage Disappearing Plug and Autofill Sub," dated 2005.
Flyer from Halliburton Corporation on the "PES PS Packer Setting Anvil Plug," dated 2006.
Baker Oil Tools' one page publication, "Disappearing Plug Technology Improves Deepwater Economics," (date unknown), p. 9.

* cited by examiner

*Primary Examiner* — Kenneth Thompson
(74) *Attorney, Agent, or Firm* — Ladas & Parry LLP

(57) ABSTRACT

Apparatus and method for a providing a completion assembly for running at an end of a completion string which provides a remotely operable tubing mounted valve used to control the flow of fluids through the tubing in hostile well conditions. The tubing mounted completion assembly has a tubular body for connection in the string below a production packer with a through bore from a first inlet and a first outlet coaxially aligned with the string; a downhole electronic actuating mechanism, a downhole hydraulic pump and a hydraulically operated ball valve member. The actuating mechanism operates the hydraulic pump to provide a hydraulic control line to control movement the valve member from a first position, where the member is open and a through bore is created between the inlet and outlet of the assembly, to a second position, where the valve seals the throughbore and, finally, back to the first position.

13 Claims, 2 Drawing Sheets

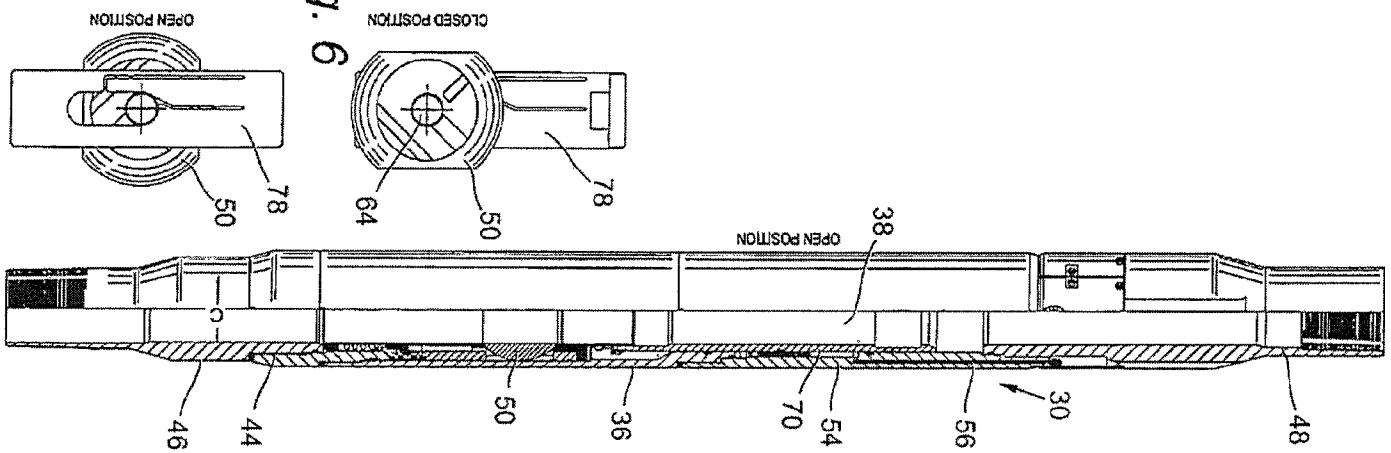
Fig. 6
Fig. 7
Fig. 4
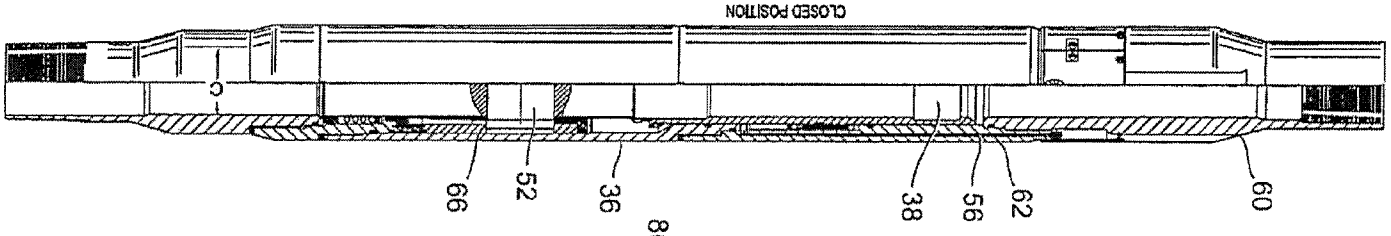
Fig. 5
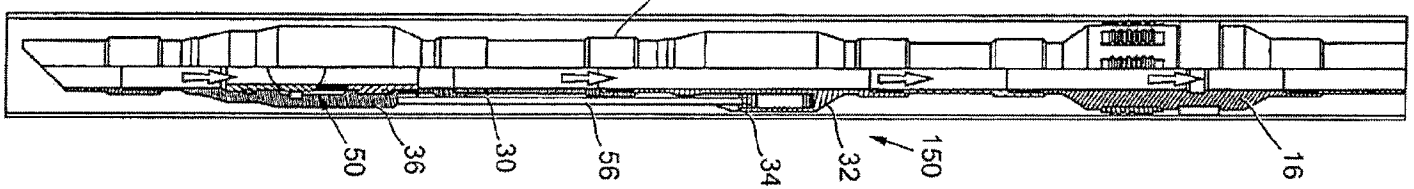
Fig. 8

ELECTRONIC COMPLETION INSTALLATION VALVE

BACKGROUND OF THE INVENTION

1. Field of the Invention

The present invention relates to valves used as plugs during completions of wells in oil and gas production. More particularly the present invention relates to an apparatus and method for providing a remotely operable tubing mounted valve used to control the flow of fluids through the tubing in hostile well conditions.

2. Background of the Related Art

When a well is completed, prior to production, a completion string is run into the well. On run in the string must be open to allow fluid to flow up the tubing of the string. In location the tubing must be sealed so that sufficient downhole pressure can be created to set the production packer mounted on the string and together provide a downhole barrier. The barrier thus allows pressure testing to be undertaken prior to the tubing string being opened so that produced oil can flow up the completion string to the surface.

In order to achieve the opening and closing of the tubing bore downhole a plug or valve is used. When a plug is used, the tubing is run into the well bore. The plug is then run in on wireline, slickline or coiled tubing and is set at a position below the production packer. Once the packer is set, a further trip down the well is required to retrieve the plug so that production can begin.

There are a number of disadvantages in using plugs run on wireline and the like. Each run into the well increases the time to achieve completion and is therefore costly. Running plugs can be dangerous during rig up/rig down. Yet further, the costs can soar if the wire breaks in the hole and the plug has to be "fished" out. Additionally some companies run tubing having a plastic coated inner surface.

Such arrangements don't allow wireline plugs to be run as they damage the coating.

Unfortunately in some environments it is more likely that wireline cannot be run as there is no wireline access to the desired location where the plug is to be positioned. This occurs in highly deviated wells or horizontal wells due to the high angle of deviation within the well at the desired position.

In order to overcome these difficulties valves are located at the end of the tubing string. Typically a hydraulically controlled valve is mounted at the end of the tubing with one or more hydraulic control lines arranged on the outer surface of the tubing up to the surface. The hydraulic control lines must pass back to the surface of the well. There are a number of major disadvantages in this arrangement. The first is that the control lines must pass through the production packer. This effectively breaks a seal in the downhole arrangement and is therefore difficult both to engineer and to operate reliably remotely from the surface. A second disadvantage is in arranging the control lines which must pass down the full length of the well. In extended reach wells at great depths, this is costly and it is difficult to reliably control the pressure in the small diameter lines at the excessive depths. Additionally, the incorporation of these control lines with there incumbent connections provide more opportunities for leak paths to exist in the string.

Recently, remotely operable plugs have been used. These are commonly referred to as disappearing plug technology. One such system is the FBIV (Full Bore Isolation Valve) available from Baker Oil Tools, U.S.A. The FBIV is a single action disc-valve which is normally closed. To operate, the FBIV is located at an end of the tubing string with a sliding sleeve multi-cycle tool (MCT) located above. The FBIV is run-in in the closed configuration with the MCT in the open position allowing the tubing string to self-fill via ports in the MCT. At depth, internal tubing pressure is applied to close the MCT so that pressure testing can be achieved. Then by applying a predetermined number of pressure cycles in the string the FBIV is cycled open for production.

An alternative disappearing plug is the 'Mirage' system by Halliburton, U.S.A. In this arrangement a plugging material is located at the end of the tubing string with an autofill sub located above it. During run in, the autofill is open allowing the infill of fluids to the tubing string above the plug. At depth, a number of pressure cycles are generated from surface which close the autofill, test the tubing and set the production packer. The Mirage plug is activated by these pressure cycles and dissolves and disintegrates with the last pressure cycle expending the plug to leave an open well bore for non-restricted production through the tubing string.

Unfortunately these prior art disappearing plugs suffer from major limitations. These prior art plugs/valves are all closed at the surface prior to run-in. They are single action, only being able to be opened remotely once. These features provide two distinct disadvantages. As they are closed during run-in, this means filling the tubing as the completion is run in the well becomes problematic and typically requires an addition piece of equipment i.e. the autofill sub or the circulation sub. These tools are unreliable and prone to debris ingress. The autofill sub only allows well fluid to pass in one direction. Therefore in a well kick situation heavier completion fluid cannot easily be circulated into the well to regain control of the well. The circulation sub does allow reverse flow but has a small flow by-pass area making it prone to blocking up with debris. Debris is a common problem downhole, for example, as the tubing is threaded together pipe dope from each connection make up will find its way into the tubing I.D. In the prior art devices, this dope and any well debris will collect on top of the plugging device. This can give problems with debris going into the mechanism and jamming it up and also with pressure transmittal through the debris itself. It is not uncommon for 20-30 ft of debris to build up above these devices.

A second disadvantage is that the majority of these devices operate by opening on a predetermined number of pressure cycles. Often during surface operations pressures may be applied inadvertently to the tubing and it becomes confusing as to whether they constitute a cycle or not, therefore it becomes less clear how many cycles are left to open the plug/valve. Additionally any shock loading during installation of the plug/valve can cause the internal mechanism to incrementally move, thus using up some cycles without knowledge by the operator. In this way, there are a limited number of pressure related functions which can be carried out without the risk of the valve/plug opening. If the pressure test needs to be repeated or the packer needs to be reset, it may be that any further pressure cycles would automatically cause the valve/plug to open and as a result, the tubing string is opened prior to the required testing or packer setting. In such a case the entire tubing string would require to be retrieved and the operation repeated from scratch. To overcome this problem some valves only operate after a large number of pressure cycles, for example ten. However, if only one cycle is required to set the packer, there is excessive time wasted in creating nine further cycles to finally get the valve to open.

SUMMARY OF THE INVENTION

It is an object for the present invention to provide a method and apparatus for performing a completion run in a well bore which obviates or mitigates at least some of the disadvantages of the prior art.

It is an object of at least one embodiment of the present invention to provide a through tubing valve which is open at surface and can be remotely operated to close and re-open within a well bore.

It is a further object of at least one embodiment of the present invention to provide a completion system which does not require an autofill or a circulation sub, the tubing being filled via a through tubing valve.

It is a yet further object of at least one embodiment of the present invention to provide a method of completing a well bore which does not require control lines to surface or the use of wireline intervention.

According to a first aspect of the present invention there is provided a tubing mounted completion assembly for running at an end of a completion string; the assembly comprising a substantially tubular body for connection in a work string below a production packer, the assembly having a through bore with a first inlet and a first outlet coaxial with the work string; a downhole electronic actuating mechanism, a downhole hydraulic pump and a hydraulically operated valve member; wherein the actuating mechanism operates the hydraulic pump to provide at least one hydraulic control line to control movement the valve member from a first position, where the member is open and a through bore is created between the inlet and outlet of the assembly, to a second position, where the valve seals the throughbore and, finally, back to the first position.

By providing hydraulic control contained within the assembly, the valve can be remotely operated and does not require hydraulic control lines to the surface. Yet further, by including a downhole actuation mechanism, no physical connection with the surface is required.

Preferably the valve member is a ball. More preferably, the ball includes an aperture running therethrough which may be positioned coaxially with the throughbore. In this way the downhole electronic actuating mechanism operates the downhole hydraulic pump to provide at least one hydraulic control line to control movement of the ball between a first position wherein the aperture is aligned with the throughbore and fluid can flow through the valve and a second position wherein the throughbore is blocked and a seal is created in the valve.

Preferably, the actuation mechanism includes a first pressure sensor located above the ball. The actuating mechanism can thus operate at predetermined downhole pressures. Preferably the actuating mechanism includes a timer. In this way the mechanism can be set to operate at fixed time periods. Alternatively an accelerometer may be used.

Preferably the actuating mechanism includes a processor. Advantageously the actuating mechanism includes a memory unit for storing measured pressure values. The mechanism may also measure and store other parameters such as temperature.

Preferably there are two hydraulic control lines, a first to close the valve and a second to open the valve. In this way each line may need only operate once for the valve to function correctly through the completion sequence. Alternatively, the lines may be operated repeatedly.

According to a second aspect of the present invention there is provided a method of controlling fluid flow in a completion string, the method comprising the steps:

(a) locating a completion assembly according to the first aspect at an end of a work string;

(b) running the work string in the well bore with the valve in the first position for fluid to flow in the inlet and out of the outlet as it fills the string;

(c) actuating the valve member to move to the second position and setting the production packer to thereby provide a downhole barrier;

(d) actuating the valve back to the first position to allow produced fluids to flow in the inlet and out of the outlet up the string.

Preferably the method includes the step of undertaking a pressure test against the valve in the second position.

Preferably the step of actuating the valve to move to the second position comprises the steps:

(a) monitoring hydrostatic pressure using the sensor on the assembly during run in;

(b) starting a timer when a predetermined value of hydrostatic pressure is reached; and (c) operating the hydraulic pump to move the valve to the second position at the end of a predetermined time period.

In this way the time for the valve to close and the packer to set can be pre-programmed into the actuating mechanism. This provides an autonomously operating system.

Advantageously the method may include the step of pulling the string so that the monitored hydrostatic pressure reduces to be below the predetermined value and thereby reset the timer. This step allows an operator to prevent closure of the valve if desired.

Preferably the step of actuating the valve to move from the second position back to the first position comprises the steps:

(a) monitoring hydrostatic pressure using the sensor on the assembly to set a reference pressure value;

(b) determining an applied pressure value using a measurement from the pressure sensor and the reference pressure value; and (c) operating the hydraulic pump to move the valve to the first position when the applied pressure meets a predetermined condition.

In this way pressure can be applied by pumping fluid through the string against the closed valve. When the actuating mechanism senses a pressure spike it can open the valve.

Preferably the method includes the steps of measuring pressure values at a plurality of sampling intervals and recording the measured pressure values.

Preferably also the method includes the additional step of detecting a pressure change effect in the wellbore using the pressure sensor.

Preferably the pressure change event is detected by calculating a rate of pressure change and comparing the rate of pressure change with a predetermined threshold.

Advantageously the method includes the step of determining whether a variation in pressure is due to a natural change in the wellbore environment, or an effected change due to a pressure applied at the surface.

Preferably the reference pressure value is selected from a plurality of measured pressure values. Preferably also the reference pressure value is lowest pressure value measured during a preceding time interval.

Preferably the predetermined condition is that the applied pressure falls within a predetermined range for a specified time period.

The method may also include the step of killing the well by pumping fluid down the string when the valve is in the open position.

BRIEF DESCRIPTION OF THE FIGURES

An embodiment of the present invention will now be described, by way of example only, with reference to the accompanying drawings of which:

FIG. 4 is a part cross-sectional illustration of a completion assembly shown in an open configuration according to an embodiment of the present invention;

FIG. 5 is a part cross-sectional illustration of a completion assembly shown in a closed configuration according to an embodiment of the present invention;

FIG. 6 is an illustration of the arrangement of the ball valve member and a ball arm of FIG. 4;

FIG. 7 is an illustration of the arrangement of the ball valve member and a ball arm of FIG. 5; and FIG. 8 is a part cross-sectional illustration of a completion assembly according to an alternative embodiment of the present invention.

DETAILED DESCRIPTION OF THE PREFERRED EMBODIMENTS

Figure 1:
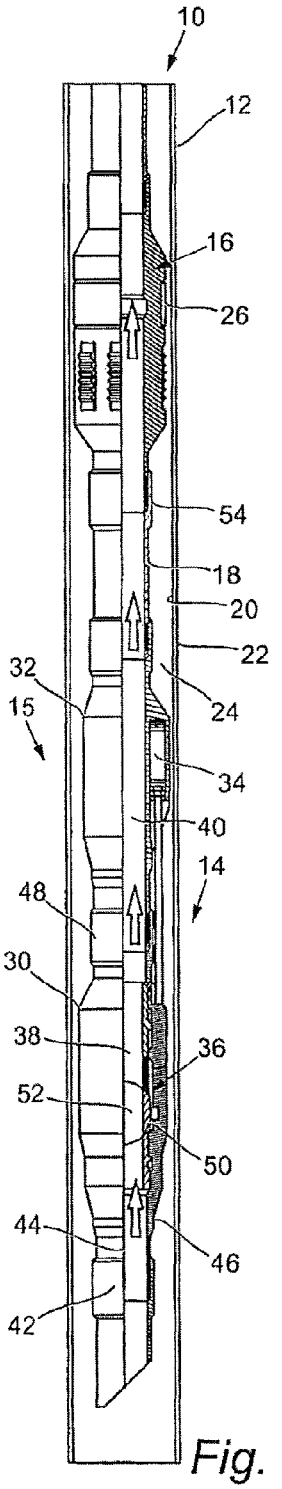
FIG. 1 is a schematic illustration of a completion work string being run in a well bore according to an embodiment of the present invention.

Reference is initially made to FIG. 1 of the drawings which illustrates a completion string, generally indicated by reference numeral 10, being run in a well bore 12 according to an embodiment of the present invention. It should be noted that wellbore 12 is cased i.e. it is lined, having been pre-drilled prior to insertion of the completion string 10.

Completion string 10 comprises a plurality of tubing sections which are cylindrical pipes fitted together via screw fittings at either end. At a lower end 14 of the string 10 there is located a production packer 16 and a completion assembly 15, according to an embodiment of the present invention.

The completion assembly 15 comprises three sections. From above, the first section is an electronic actuating mechanism 32. This is connected to a hydraulic pump 34 which in turn is connected to a valve 30 containing a ball valve mechanism 36 towards the lower end 14 of the string 10. These parts will be described later in greater detail with reference to FIGS. 4, 5, 6 and 7. In the embodiment shown the actuating mechanism 32 and the pump 34 are housed together. They could be located separately. Advantageously, the valve 30 is contained separately to isolate possible debris ingress to the valve mechanism 30.

During run in, as show in FIG. 1, the valve 30 is operated in an open configuration. A ball valve member 50, located in the valve mechanism 36, includes an aperture 52. In the open configuration, aperture 52 is aligned coaxially with the bore 40. In this way, fluid can fill the tubing string 10 from an inlet 42 at a lower end 14 of the string 10, through an inlet 44 at the lower end 46 of the valve 30, directly through the valve 30 to exit at an outlet 48 of the valve into the bore 40 of the string 10 for passage to the surface of the well.

Each of the sections 32,34,36 has a throughbore 38 which is co-axial with the bore 40 of the string 10. In this way, there is an unimpeded flow of fluid through the assembly 15 when the string 10 is run in the wellbore 12. Further, there is no requirement to have any flow through the wall 54 of the string 10 and thus there is no tortuous path required for fluid flow around or through the tubing string 10 during run in.

Figure 2:
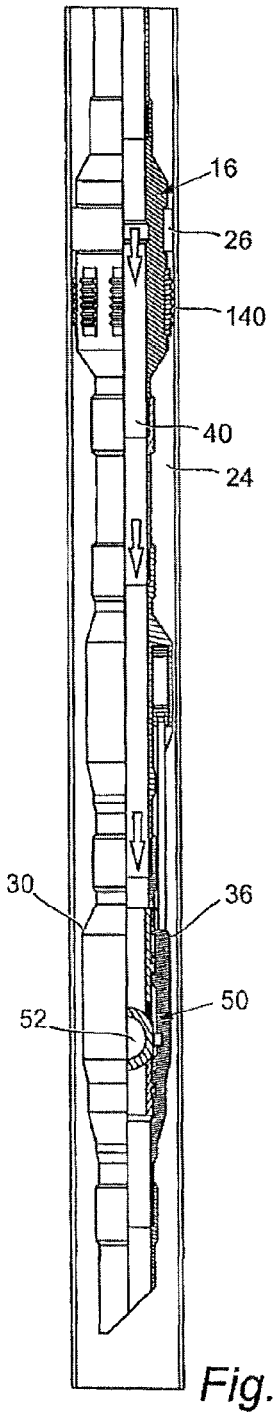
FIG. 2 is a schematic illustration of a completion work string shown when the production packer has been set in a well bore according to an embodiment of the present invention.

Reference is now made to FIG. 2 of the drawings which illustrates the string 10 now located in a desired position in the well bore 12. Like parts to those of FIG. 1 have been given the same reference numeral to aid clarity. In this location, a predetermined set of well conditions are detected at the actuating mechanism 32. The actuating mechanism 32 then operates the hydraulic pump 34 to actuate the ball valve mechanism 36 to turn the ball valve member 50 so that the aperture 52 now lies perpendicular to the bore 40. This creates a seal in the bore 40 at the ball valve mechanism 36, preventing fluid flow up or down through the valve 30.

With the valve 30 now in the closed position, downhole fluid pressure is increased to set the production packer 16 by virtue of the slips 140 gripping the inner wall 20 of the casing 22 and the seal 26 being compressed so that it expands radially to fill the annulus 24. Setting the production packer 16 anchors the completion string 10 in the well bore 12 and provides a seal between the outer surface 18 of the string and the inner wall 20 of the casing 22 in the annulus 24 between the string 10 and the wellbore 12.

With the packer 16 set and the valve 30 closed, a downhole barrier is created in the well. A pressure test can be performed.

Figure 3:
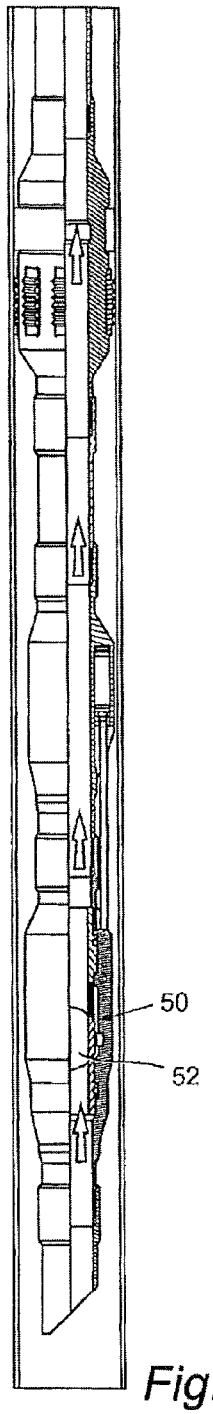
FIG. 3 is a schematic illustration of a completion work string in a well bore with produced fluids flowing through the string according to an embodiment of the present invention.

With the production packer 16 set, surface work can be completed i.e. nipple down BOP, put on the Christmas Tree and connect production lines. Well production can then begin by opening the valve 30. This is illustrated in FIG. 3.

Actuation of the ball valve mechanism 36 to remotely open and close the valve 30 will now be described with reference to FIGS. 4, 5, 6 and 7.

Actuation of the ball 50 is achieved via the electronic actuation mechanism 32 in combination with the hydraulic pump 34. Actuation mechanism 32 comprises a control module with electronic capability which monitors well pressure, temperature, and time. It may also include other sensors such as an accelerometer. A logic processor inside the module is pre-programmed to perform logical operations and calculations relating to the measured signals. A battery is also included in the module to provide a remote power supply so that the electronic actuating mechanism is entirely independent of any control lines or electronic signalling from the surface of the well bore. There is a motor and gearbox within the mechanism 32 to operate the hydraulic pump 34. It should be noted that all the components of the electronic actuating mechanism 32 and the hydraulic pump 34 are arranged around a cylindrical bore 38 of the valve 30. In this way a fluid passageway is maintained through the valve 30 in line with the tubing bore 40.

In response to predetermined well conditions being reached, the module will turn on and off the motor and gearbox as required. When the motor is turned on, the hydraulic pump 34 is controlled from the module. The hydraulic pump 34 provides at least one hydraulic control line 56 to the ball valve mechanism 36. In a preferred arrangement there are a pair of hydraulic control lines leading from the pump 34 to the ball valve mechanism 36 in the valve 30.

Valve 30 comprises a substantially cylindrical body 60 having an axial bore 38 running therethrough. The body 60 comprises a control line access sleeve 62 connected to the ball valve mechanism 36. The ball valve mechanism 36 includes a ball valve member 50 arranged on a pivot 64 so that it can rotate within the bore 38. The ball member 50 includes an aperture 52 running therethrough, the aperture being ideally sized to match the diameter of the bore 38. Also within the mechanism 36 is a ball arm 78 operated via a piston 70.

At surface, the valve 30 is located in the string 10 in an open configuration, that is the aperture 52 is arranged coaxially with the bore 38. At the desired location, the actuation mechanism 32 operates the hydraulic pump 34 and fluid is pumped through a control line 56 to the valve mechanism 36. The fluid acts upon a surface of the piston 70 to raise the piston and consequently the ball arm 78.

Movement of the ball arm 78, via a pin located between the ball arm and ball member 50, causes the ball member to be rotated to the closed position. This is the point where the aperture 52 now lies perpendicular to the bore 38. A sealing arrangement as is known in the art is used to between the ball member 50 and the housing 66 to prevent fluid leakage around the member.

When the valve requires to be opened downhole, the actuating mechanism 32 detects the required well conditions. The hydraulic pump 34 is operated and fluid is pumped through a second control line. The second control in delivers fluid to a chamber on a second face of the piston 70. This pushes the piston and ball arm downwards and again rotates the ball member 50 back to its starting position. Advantageously, as the ball member 50 rotates, a collet finger of the ball arm engages the ball member via a snap latch mechanism so that the ball member 50 is held in position.

It will be appreciated by those skilled in the art that any suitable hydraulically controlled valve arrangement may be used in the completion assembly of the present invention. A ball valve is advantageously selected as this requires minimal length on the completion string and can hold pressure from both above and below.

Reference is now made to FIG. 8 of the drawings which illustrates a completion assembly 150 according to a further embodiment of the present invention. Like parts to those of the earlier Figures have been given the same reference numerals to aid clarity. Assembly 150 is identical to assembly 15 except in that the hydraulic pump 34 and the valve 30 are now separated by a tubing section 80. The control line 56 is extended to pass across the section 80. However, this control line is still relatively short and remains entirely below the production packer 16 on the string 10. As debris can build up above the ball member when the valve is in the closed position, separating the actuating mechanism from the valve ensures that the sensor or its readings are not affected by the debris. In this way, further tubing sections could be arranged between the pump 34 and the valve 30 dependant on the expected debris which may collect. Of course, with the valve opened the debris can be easily pumped away.

The principle advantage of the present invention is that it provides an apparatus and method for a remotely operating tubing mounted valve to control the flow of fluid through a completion string.

A further advantage of the present invention is that it provides an apparatus and method for a remotely operating tubing mounted valve in a completion string which does not require any control lines to surface. It does not require any signalling to surface either. The control module applies pressure via the pump to the control lines contained within the valve which in turn open and close the valve. This negates the need to take the control lines back to surface. This also eliminates the need for a control line feed through the packer, and control line clamps which would be necessary if the control line had to be taken back to surface. This reduces potential leak paths and cost.

A yet further advantage of the present invention is that it provides an apparatus and method for a remotely operating tubing mounted valve in a completion string which is controlled to fail in an open position. During run-in the any tool on a completion string will be subjected to jarring and collisions. These can cause a tool to malfunction. For the valve in the present invention, as it is run-in in the open configuration it will fail in this configuration and thus leave a clear bore for access. In the prior art devices which are run in with the valve in a closed configuration, any failure causes a blockage in the well which is costly to drill out.

A yet further advantage of the present invention is that it provides an apparatus and method for a remotely operating through tubing valve in a completion string which is resettable and has a throughbore removing the need to run the valve with a circulation or autofill sub. This also allows the valve to be used to address well kill situations as it provides a complete open bore through which fluids can be pumped.

A still further advantage of the present invention is that it provides an apparatus for a remotely operating through tubing valve in a completion string which has no frangible or dissolving parts so there is no possibility of loose parts being left in the well bore. Additionally the valve shouldn't allow debris build up and if it does it can be circulated out before closing the valve.

Various modifications may be made to the invention herein described without departing from the scope thereof. For example, any number of hydraulic control lines can be made to the ball valve mechanism as desired. Additionally, any hydraulic control system for a valve could be used.

The invention claimed is:

1. A method of controlling fluid flow in a completion string, the method comprising the steps:

(a) locating a completion assembly at an end of a tubing string, wherein the completion assembly comprises a substantially tubular body for connection in the tubing string below a production packer, the assembly having a through bore with a first inlet and a first outlet coaxial with the tubing string; a downhole electronic actuating mechanism a downhole hydraulic pump and a hydraulically operated valve member; wherein the actuating mechanism operates the hydraulic pump to provide at least one hydraulic control line to control movement of the valve member from a first position, where the member is open and a through bore is created between the inlet and outlet of the assembly, to a second position, where the valve seals the through bore and, finally, back to the first position, the valve member being operable in the first position for running the tubing string into a wellbore;

(b) running the tubing string into the well bore with the valve in the first position for fluid to flow in the inlet and out of the outlet as it fills the string;

(c) actuating the valve member to move to the second position and setting the production packer to thereby provide a downhole barrier;

(d) actuating the valve back to the first position to allow produced fluids to flow in the inlet and out of the outlet up the string.

2. A method of controlling fluid flow in a completion string according to claim 1 wherein the method includes the step of undertaking a pressure test against the valve in the second position.

3. A method of controlling fluid flow in a completion string according to claim 1 wherein the step of actuating the valve to move to the second position comprises the steps:

(a) monitoring hydrostatic pressure using the sensor on the assembly during run in;

(b) starting a timer when a predetermined value of hydrostatic pressure is reached; and (c) operating the hydraulic pump to move the valve to the second position at the end of a predetermined time period.

4. A method of controlling fluid flow in a completion string according to claim 3 wherein the method includes the step of pulling the string so that the monitored hydrostatic pressure reduces to be below the predetermined value and thereby resets the timer.

5. A method of controlling fluid flow in a completion string according to claim 1 wherein the step of actuating the valve to move from the second position back to the first position comprises the steps:

(a) monitoring hydrostatic pressure using the sensor on the assembly to set a reference pressure value;

(b) determining an applied pressure value using a measurement from the pressure sensor and the reference pressure value; and (c) operating the hydraulic pump to move the valve to the first position when the applied pressure meets a predetermined condition.

6. A method of controlling fluid flow in a completion string according to claim 1 wherein the method includes the steps of measuring pressure values at a plurality of sampling intervals and recording the measured pressure values.

7. A method of controlling fluid flow in a completion string according to claim 1 wherein the method includes the additional step of detecting a pressure change event in the wellbore using the pressure sensor.

8. A method of controlling fluid flow in a completion string according to claim 7 wherein the pressure change event is detected by calculating a rate of pressure change and comparing the rate of pressure change with a predetermined threshold.

9. A method of controlling fluid flow in a completion string according to claim 7 wherein the method includes the step of categorising the pressure change as one of a group comprising: a variation in pressure due to a natural change in the wellbore environment and effected change due to a pressure applied at the surface.

10. A method of controlling fluid flow in a completion string according to claim 5 wherein the reference pressure value is selected from a plurality of measured pressure values.

11. A method of controlling fluid flow in a completion string according to claim 5 wherein the reference pressure value is the lowest pressure value measured during a preceding time interval.

12. A method of controlling fluid flow in a completion string according to claim 1 wherein the pre-determined condition is that the applied pressure falls within a predetermined range for a specified time period.

13. A method of controlling fluid flow in a completion string according to claim 1 wherein the method includes the step of killing the well by pumping fluid down the string when the valve is in the open position.

* * * * *